US006747197B2

(12) United States Patent
Kellogg

(10) Patent No.: US 6,747,197 B2
(45) Date of Patent: Jun. 8, 2004

(54) STRINGED INSTRUMENT STAND

(76) Inventor: Greg Kellogg, 2072 Covington Ave., Simi Valley, CA (US) 93065

( * ) Notice: Subject to any disclaimer, the term of this patent is extended or adjusted under 35 U.S.C. 154(b) by 0 days.

(21) Appl. No.: 10/218,434

(22) Filed: Aug. 15, 2002

(65) Prior Publication Data

US 2004/0031373 A1 Feb. 19, 2004

Related U.S. Application Data

(63) Continuation-in-part of application No. 09/371,384, filed on Aug. 10, 1999, now Pat. No. 6,130,375.

(51) Int. Cl.[7] ..... G10G 5/00

(52) U.S. Cl. ..... 84/327; 84/278; 84/279; 84/280; 84/281; 84/453

(58) Field of Search ..... 84/327, 278, 279, 84/280, 281, 379, 387 A, 453

(56) References Cited

U.S. PATENT DOCUMENTS 160,136 A * 2/1875 Albert ..... 84/279
821,803 A * 5/1906 Hughes ..... 84/278
850,775 A * 4/1907 Morrissey ..... 84/278

* cited by examiner

*Primary Examiner*—Shih-Yung Hsieh

(57) ABSTRACT

Improved Stringed Instrument Stand with an L shaped bracket having a centrally located clevis joint, a hinged flat stand member, and a retaining clip, the L shaped member capable of retaining a washer, the washer having a plurality of engagement fingers that are able to engage with one of a plurality of mating linear engagement receptacles. The washer has a centrally located aperture that allows the retention of a strap holding screw of a stringed instrument. The washer is able to be placed higher or lower within the L shaped bracket thereby allowing stringed instruments having different body thickness's to be accommodated by the bracket without having to drill additional holes in the body the stringed instrument. A hinged flat stand member folds open to help hold the instrument in an upright position when being placed on a flat surface and folded closed when the instrument is being played.

2 Claims, 3 Drawing Sheets

STRINGED INSTRUMENT STAND

CROSS REFERENCE TO RELATED APPLICATIONS

This is a continuation in part of Ser. No. 09/371,384, filed on Aug. 10, 1999, now U.S. Pat. No. 6,130,375.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of Instrument accessories and more specifically to improved Stringed Instrument Stand.

Stringed instruments such as guitars and the like often need to be temporarily held in a relatively upright position when not being used, such as when a person is giving a performance on a stage and needs to switch from one instrument to another.

My issued U.S. Pat. No. 6,130,375 discloses such an instrument stand that attaches directly to the body of the instrument by means of the screw attaches to the instrument body that normally holds one end of a strap. This stand folds flat when the user is playing the instrument or when the instrument is stored and folds out when used as a stand.

A deficiency in my original design is that it is hard for the invention to accommodate instruments having bodies of different thickness's because the location of the strap holding screw may be in an unsuitable location. For example an acoustic guitar has a relatively thick body whereas an electric guitar has a thinner body. Therefore the strap holding screw may be in a location that may make the attachment of my original instrument stand difficult without drilling an additional hole in the instrument. The addition of a hole is undesirable and in some cases would interfere with the structural integrity of the instrument.

BRIEF SUMMARY OF THE INVENTION

The primary object of the invention is to provide an improved stringed instrument stand that allows the user to attach instruments of different thickness's to the stand without having to drill additional holes in the body of the instrument.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed Improved Stringed Instrument Stand comprising: an L shaped bracket having a centrally located clevis joint, a hinged flat stand member, and a retaining clip, said L shaped member capable of retaining a washer, said washer having a plurality of engagement fingers that are able to engage with one of a plurality of mating linear engagement receptacles within said L shaped bracket, said washer having a centrally located aperture that allows the retention of a strap holding screw of a standard stringed instrument, and said washer able to be placed higher or lower within said L shaped bracket thereby allowing stringed instruments having different body thickness's to be accommodated by said bracket without having to drill additional holes in the body said stringed instrument.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
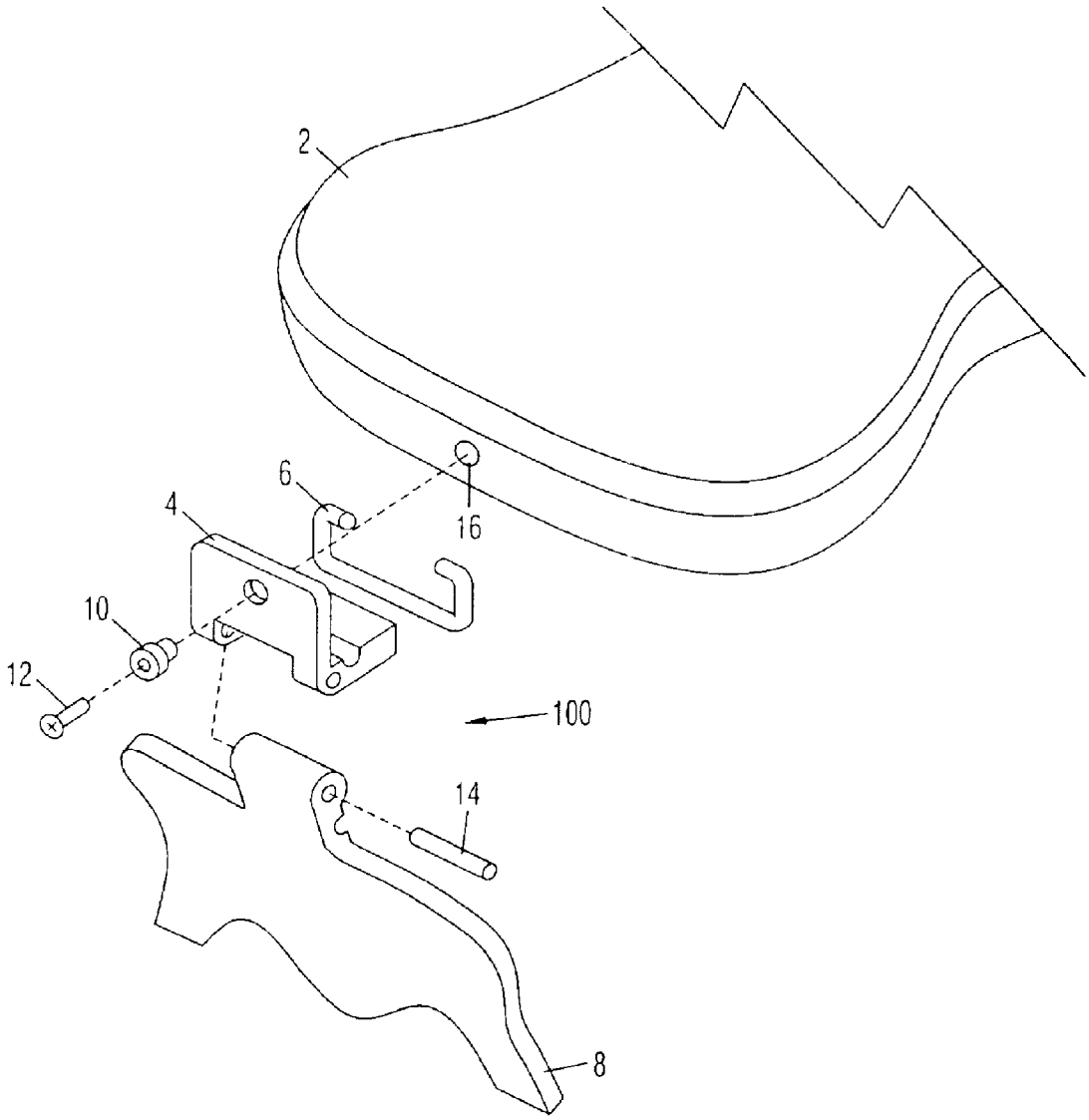
Fig. 1 Prior Art
FIG. 1 is an exploded view of the original version of my invention.
Figure 2:
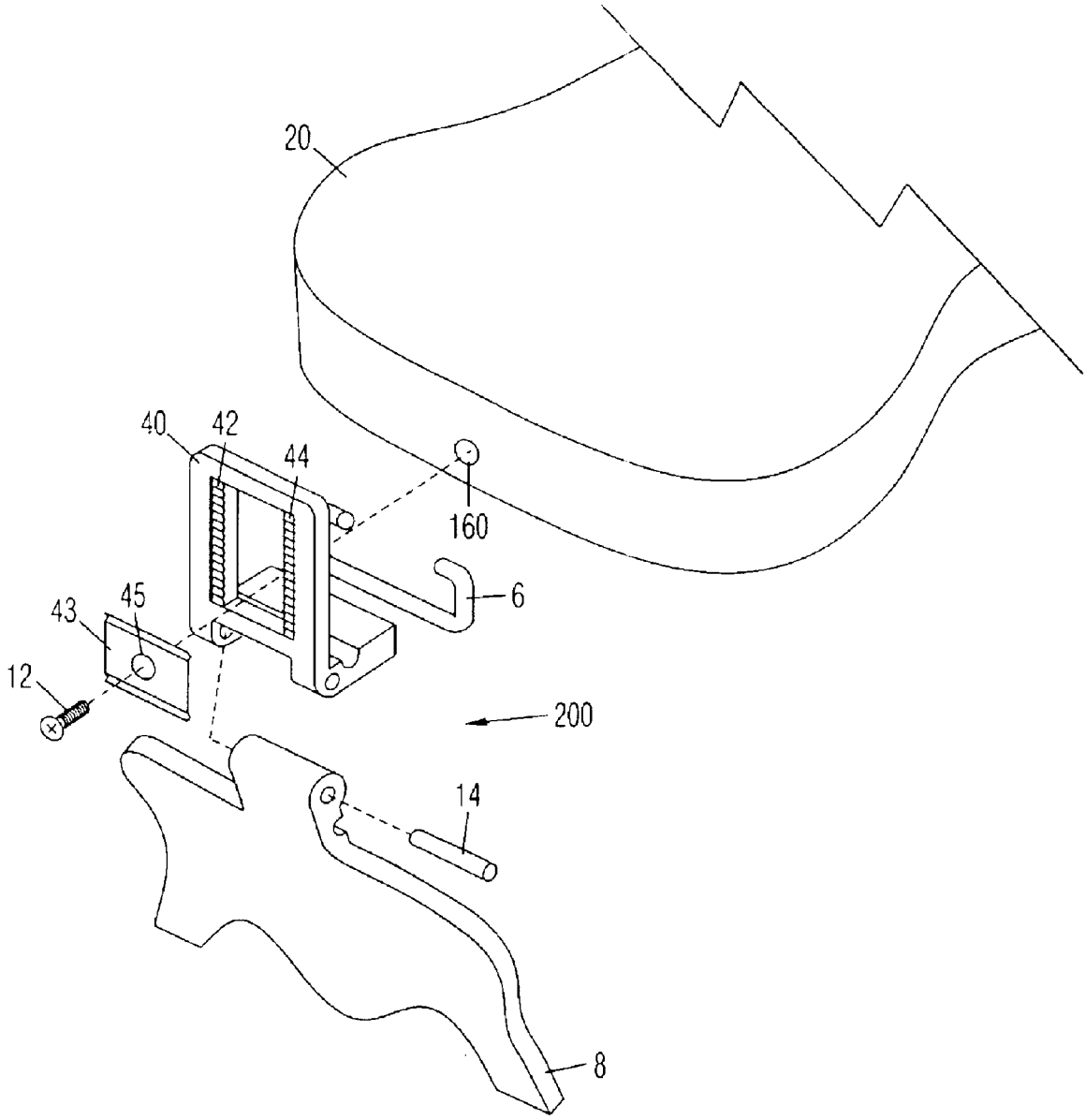
FIG. 2 is an exploded view of the present version of my invention.

Referring now to FIG. 1 we see an exploded view of the original version of my invention 100. L bracket 4 is attached to guitar body 2 by screwing screw 12 into threaded aperture 16. The rest of the instrument stand has been explained in my previous U.S. Pat. No. 6,130,375. Guitar stand 8 pivots about shaft 14 and can be set in a folded position for playing and storage,or an open position when being used as a stand. Although L shaped bracket 4 works well for electric guitars, it is problematic for other instruments such as acoustic guitars and the like because the thickness of the body of an acoustic guitar does not allow the screw 12 to align with the existing screw retaining aperture in the acoustic guitar body. FIG. 2 shows an exploded view of the new design of the present invention 200. In the present embodiment, one arm of L shaped bracket 40 has been extended and includes a pair of vertically oriented ribbed strips 42, 44 and an opening between said ribbed strips. Each rib has a V shaped cross section. Washer 43 includes a pair of integral downwardly facing V shaped members that fit into the V shapes of ribbed strips 42, 44. The user can place the washer higher or lower on the L shaped bracket so that the aperture 45 will line up with the aperture 160 of the guitar body. The user then can screw in screw 12 to attach the entire assembly 200 to guitar 20. In this way, a person can adapt the instrument stand of the present invention to fit a wide variety of instruments from relatively flat electric guitars to much thicker acoustic guitars and other stringed instruments.

Figure 3:
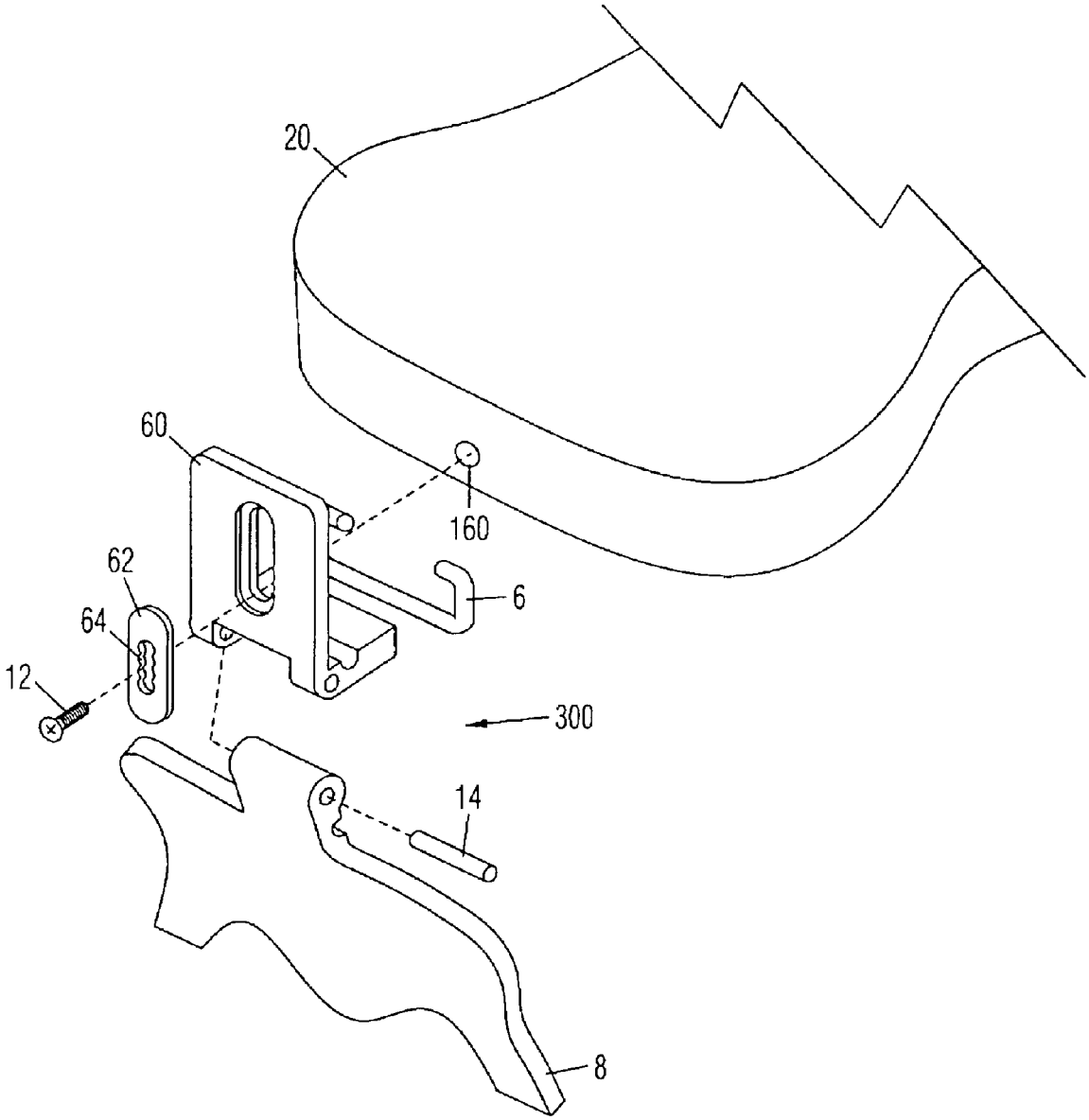
FIG. 3 an alternate exploded view of the present invention.

FIG. 3 shows an alternate embodiment 300 where Washer 64 fits into an aperture in L shaped bracket 60. The washer has a plurality of vertically placed apertures 64 that allow the user to insert screw 12 in the proper location to align with aperture 160 in guitar body 20. The the apertures 64 in washer 62 are offset so that when washer 62 is rotated one hundred and eighty degrees there are twice as many choices for aligning screw 12 with aperture 60.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. An improved stringed instrument stand, comprising:

a L shaped bracket having a centrally located clevis joint;

a hinged flat stand member; and a retaining clip; wherein said L shaped member retains a washer, said washer having a plurality of engagement fingers engaged with one of a plurality of mating linear engagement receptacles within said L shaped bracket;

said washer having a centrally located aperture for retaining a strap holding screw of a standard stringed instrument; and said washer is linearly adjustable within said L shaped bracket thereby allowing stringed instruments having different body thickness to be accommodated by said bracket without having to drill additional holes in the body of said stringed instrument.

2. An alternative embodiment of said improved stringed instrument stand as claimed in claim 1 wherein said L shaped bracket accepts a washer that remains in place, said washer having a plurality of linearly disposed apertures, said apertures for retaining said strap holding screw for enabling said screw to be placed in the ideal location with respect to the thickness of said body of said instrument.

* * * * *